US005117590A

United States Patent [19]

Kudo et al.

[11] Patent Number: 5,117,590

[45] Date of Patent: Jun. 2, 1992

[54] METHOD OF AUTOMATICALLY CHAMFERING A WAFER AND APPARATUS THEREFOR

[75] Inventors: Hideo Kudo, Fukushima; Makoto Takaoka, Sukagawa, both of Japan

[73] Assignee: Shin-Etsu Handotai Co., Ltd., Tokyo, Japan

[21] Appl. No.: 381,984

[22] Filed: Jul. 19, 1989

[30] Foreign Application Priority Data

Aug. 12, 1988 [JP] Japan ..... 63-202436
Jul. 4, 1989 [JP] Japan ..... 1-171107

[51] Int. Cl.[5] ..... B24B 9/06

[52] U.S. Cl. ..... 51/283 E; 51/101 R; 51/215 CP; 51/215 UE

[58] Field of Search ..... 51/283 E, 283 R, 215 CP, 51/215 H, 215 E, 118, 131.1, 132, 101 R

[56] References Cited

U.S. PATENT DOCUMENTS 4,002,246 1/1977 Brandt et al. ..... 51/215 CP
4,638,601 1/1987 Steere et al. ..... 51/283 E

FOREIGN PATENT DOCUMENTS 3041147 5/1981 Fed. Rep. of Germany .

OTHER PUBLICATIONS

C. G. Metreaud, Article Handling System, IBM Technical Disclosure Bulletin, Dec. 1966, vol. 9, No. 7, pp. 953-954.

*Primary Examiner*—Robert A. Rose
*Attorney, Agent, or Firm*—Cushman, Darby & Cushman

[57] ABSTRACT

A method of automatically chamfering a wafer and an apparatus therefor are disclosed. The method comprises the steps of supplying a wafer, positioning and setting the wafer on working stages, chamfer-machining the wafer on the working stages, and recovering the wafer, all the steps being continuously performed on a full-automatic basis. The apparatus comprises a wafer supply means, a wafer positioning and setting means, a chamfer-machining means for the wafer, a wafer recovering means, and a wafer transferring means. Since the method and apparatus therefor enables performance of a series of those operations on a continuous and full-automatic basis, it is possible to enhance the operating efficiency and machining ability and, at the same time, to achieve manpower reduction.

20 Claims, 13 Drawing Sheets

METHOD OF AUTOMATICALLY CHAMFERING A WAFER AND APPARATUS THEREFOR

FIELD OF THE INVENTION

The present invention relates to a method of automatically chamfering a wafer for use in manufacturing a semiconductor electronic device and an automatically wafer chamfering apparatus for the same use.

BACKGROUND OF THE INVENTION

Silicon, which constitutes one example of a base material of a semiconductor wafer for use in manufacturing a semiconductor device, is very hard and brittle and has a single crystal structure. For these reasons, it is very likely to be cracked in a specified direction. In addition, the integrated circuit manufacturing process has in recent years been being automatized. Under such existing circumstances, a semiconductor wafer is subjected to repeated travellings and positionings through the processes. Therefore, it is necessary to have the wafer chamfered or bevel-machined at its outer peripheral edge, to prevent its edge being broken off or chipped during the integrated circuit manufacturing process. Such damages at the wafer's edge allow small fractured pieces or powders of silicon to be produced and they, together with environmental dusts, can cause a reduction in the yield as well as a degradation in the characteristics of the integrated circuits being produced.

For the above-mentioned reasons, during the process of manufacturing a wafer, chamfering or bevelling is conventionally performed along the outer peripheral edge of a wafer. More specifically, this chamfering operation is carried out by applying a rotary working tool such as a grinding wheel against the outer peripheral edge of the wafer.

By the way, the outer peripheral region of a wafer is usually partly formed with an orientation flat (hereinafter referred to as "orientation-flat portion") for indicating the orientation of the crystalline structure across the surface, and therefore for enabling the positioning of an optical pattern or the like. This orientation-flat portion is formed by linearly grinding off a part of the outer peripheral region of the wafer.

Accordingly, chamfering of a wafer having an orientation-flat portion includes chamfering of the linear portion and chamfering of the remaining almost circular portion. As a result, the chamfering operation becomes complicated and expensive, and it is difficult to achieve a high level of chamfering precision.

In view of the above, various methods and apparatuses for effecting the chamfering of wafers have hitherto been proposed.

For instance, Japanese Patent Examined Publication No. 57-10568 discloses an apparatus in which the so-called "copy grinding" method is adopted. In this apparatus, a wafer to be chamfered is sandwiched between the seat plate of an upper shaft and the seat plate of a lower shaft and, on the other hand, a master wafer is coaxially disposed relative to the wafer to be chamfered, thereafter a grinding wheel is moved in such a manner as to follow the master wafer.

Further, Japanese Patent Unexamined Publication No. 59-224250 discloses a method of chamfering a pair of wafers simultaneously.

Although methods and apparatuses concerning the chamfering operation per se have indeed been proposed, no proposal has yet been made of a method and an apparatus therefor in which a series of steps including supply of wafers, chamfering of wafers, and transfer and recovery of wafers are performed on a full-automatic basis. The existing circumstances are that such a series of steps are carried out with the use of manpower, and that, accordingly, such an operation requires a large amount of time and labor. Enhancement in operating efficiency and reduction in labor have thus been eagerly desired.

SUMMARY OF THE INVENTION

The present invention has been made in view of the above-mentioned actual circumstances. An object of the present is to provide a method of automatically chamfering a wafer and an apparatus therefor which is capable of performing a series of steps including supplying wafers, chamfering wafers, and transferring and recovering wafers on a full-automatic basis, thereby enabling a reduction in labor as well as an increase in operating efficiency for the whole chamfering operation.

To attain the above object, the method of automatically chamfering a wafer in accordance with the present invention involves a wafer supplying step of sequentially supplying or delivering a wafer one by one, a wafer positioning and setting step for positioning and setting the supplied wafer on a plurality of working stages, a machining step for machining the whole periphery of the positioned and set wafer for and chamfer-machining the wafer, a wafer transferring step for transferring the machined wafer between one working stage and another working stage and a wafer recovering step for finally recovering the wafer, all of the steps being executed on a continuous and full-automatic basis.

Further, in accordance with the present invention, the orientation-flat portion and the remaining outer peripheral edge of the wafer are machined on corresponding working stages. On the other hand, the machining wheel for each working stage has its position determined through five positioning operations—three-directional movements along X-, Y-, and Z-axis that intersect one another at right angles, rotation about one axis, and movement in the direction of a rotational axis of the grinding or machining wheel. Further, the construction of the present invention includes a wafer inversion means for reducing the number of the working stages, and a wafer-chuck cleaning means serving to clean a wafer chuck for the corresponding working stage.

The apparatus for automatically chamfering a wafer in accordance with the present invention is characterized in that it comprises a wafer supply means for sequentially supplying wafers one by one, a wafer positioning and setting means for positioning the wafer thus supplied and positioning/setting it on working stages, a chamfer-machining means for chamfering the wafer thus positioned and set, a wafer transferring means for transferring the wafer thus chamfered from the wafer positioning and setting means to the chamfer-machining means and a wafer recovering means for transferring the wafer from the chamfer-machining means to the wafer recovering means.

Since the method and apparatus therefor in accordance with the present invention enables the performance of a series of steps including supply or delivery of wafers, positioning/setting of wafers, chamfering of wafers, transferring of wafers and recovery of wafers on a full-automatic basis, it is possible to enhance the operating efficiency and machining ability and, at the same time, to achieve manpower reduction. Incidentally, if angles of the inclination of chamfering are in a large number combined in each working stage and in exchange of a grinding wheel a polishing buff for example is employed for the working tool, the chamfered portion of the wafer would be able to have a smooth, continuous and curved surface. At the same time, the smoothness and chamfering precision of the chamfered portion would be increased.

Other objects, features and advantages of the present invention will become apparent from the following description when read in conjunction with the accompanying drawings.

DESCRIPTION OF THE PREFERRED EMBODIMENTS

An embodiment of the present invention will now be described below with reference to the accompanying drawings.

Figure 1:
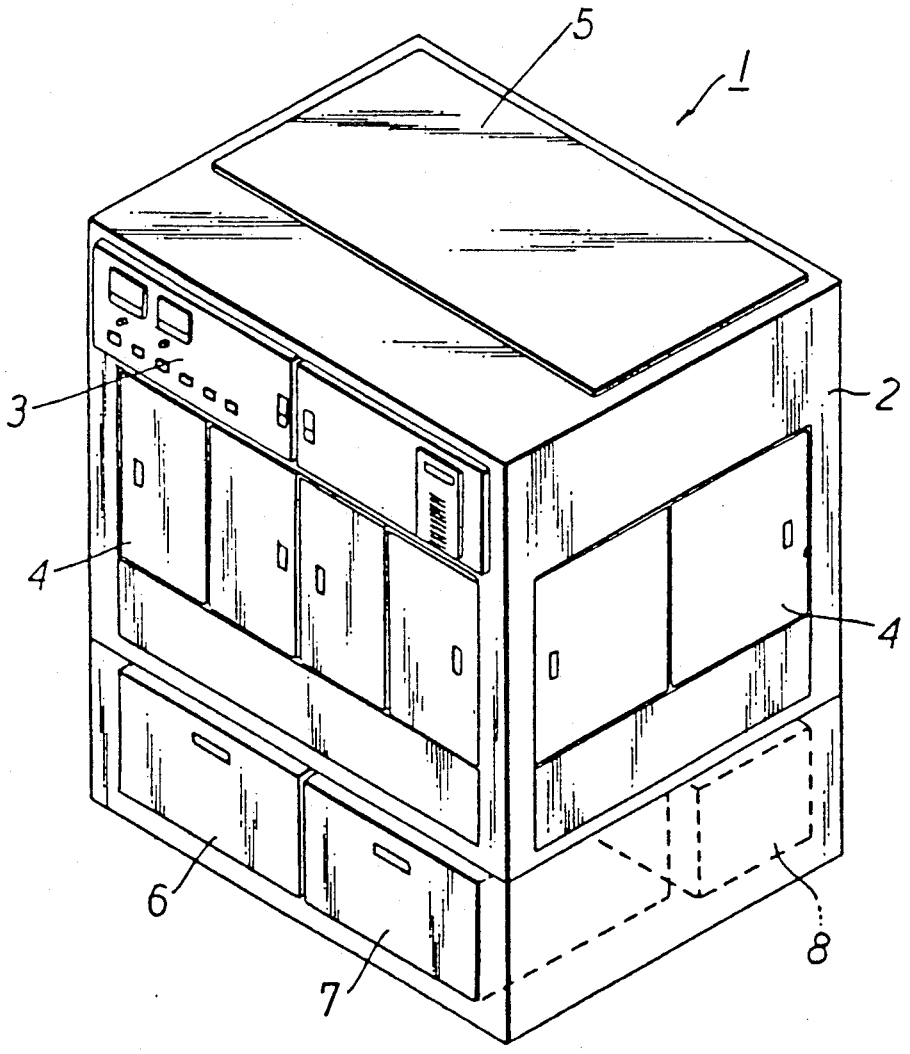
FIG. 1 is a perspective view of an automatic wafer chamfering apparatus in accordance with the present invention.

FIG. 1 is a perspective view showing the construction of an automatic wafer chamfering apparatus 1 according to the present invention. In FIG. 1, reference numeral 2 denotes a box-shaped casing, which is provided, at its front upper portion, with an operation box 3. The casing 2 is also provided, in its front and side surfaces, with a plurality of see-through or transparent windows 4, through which the interior of the casing is monitored.

Further, the casing 2 is also provided, at its top, with a filter unit 5 for removal of dust from the intake air. Furthermore, the casing is also provided, at its lower part, with a suction box 6 for sucking in the ambient air, a slurry tank 7 for accommodating a slurry as an abradant, and a control box 8 for accommodating various control devices.

Figure 2:
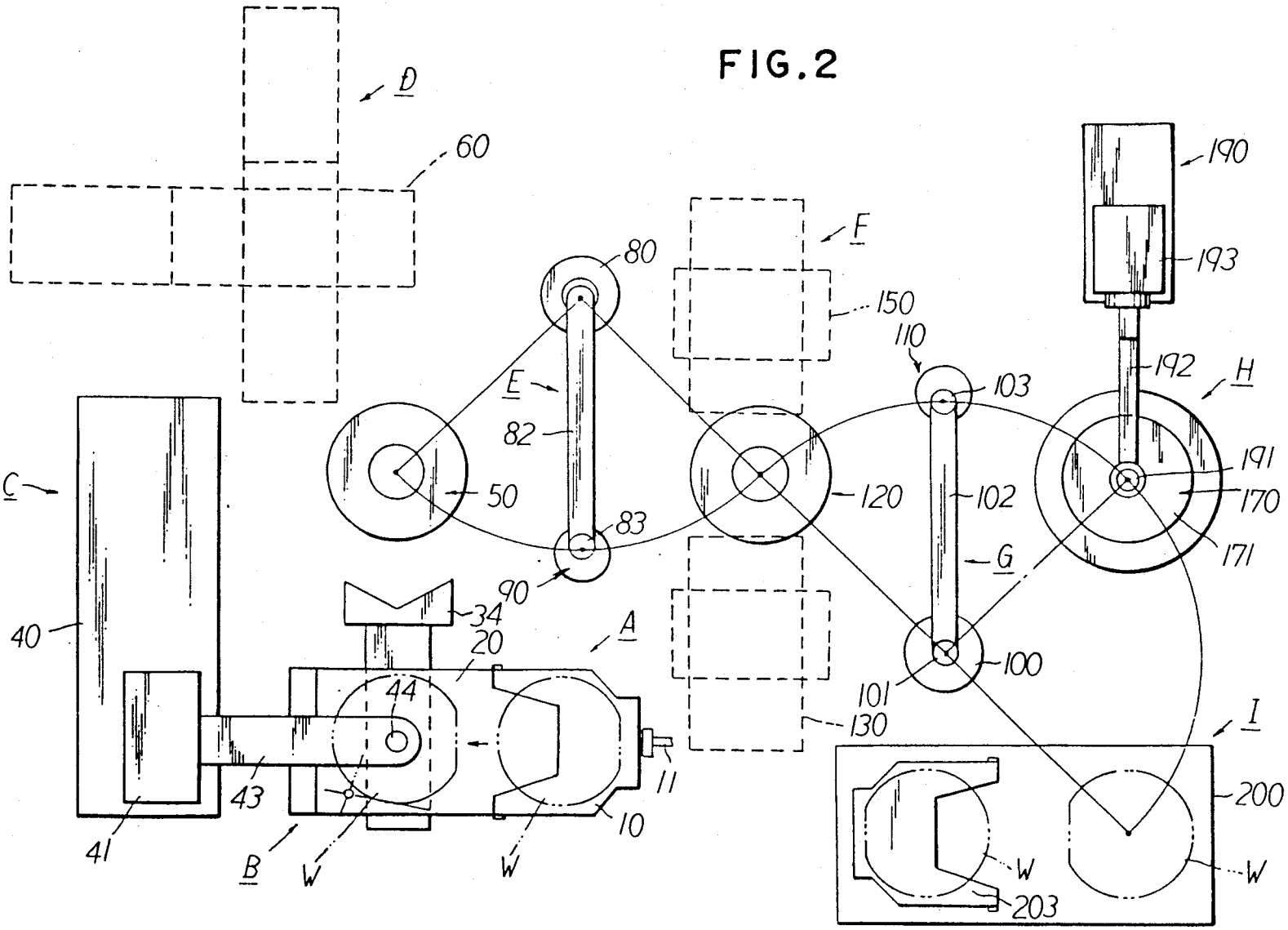
FIG. 2 is a plan view showing the construction of an essential portion of the apparatus shown in FIG. 1.

In the interior of the casing 2 and at the height of the windows 4, there is provided a main part of the automatic wafer chamfering apparatus 1, the construction of which is shown in FIG. 2.

Namely, FIG. 2 is a schematic plan view showing the construction of a main part of the automatic wafer chamfering apparatus 1, the apparatus being used for chamfering a wafer with the orientation-flat portion, and including a wafer supply or delivering means A, a wafer positioning and setting means B, a first wafer transferring means C, an orientation-flat portion chamfering means D, a second wafer transferring means E, a circular periphery chamfering means F, a third transferring means G, a wafer inversion means H, and a wafer recovering means I.

Figure 3:
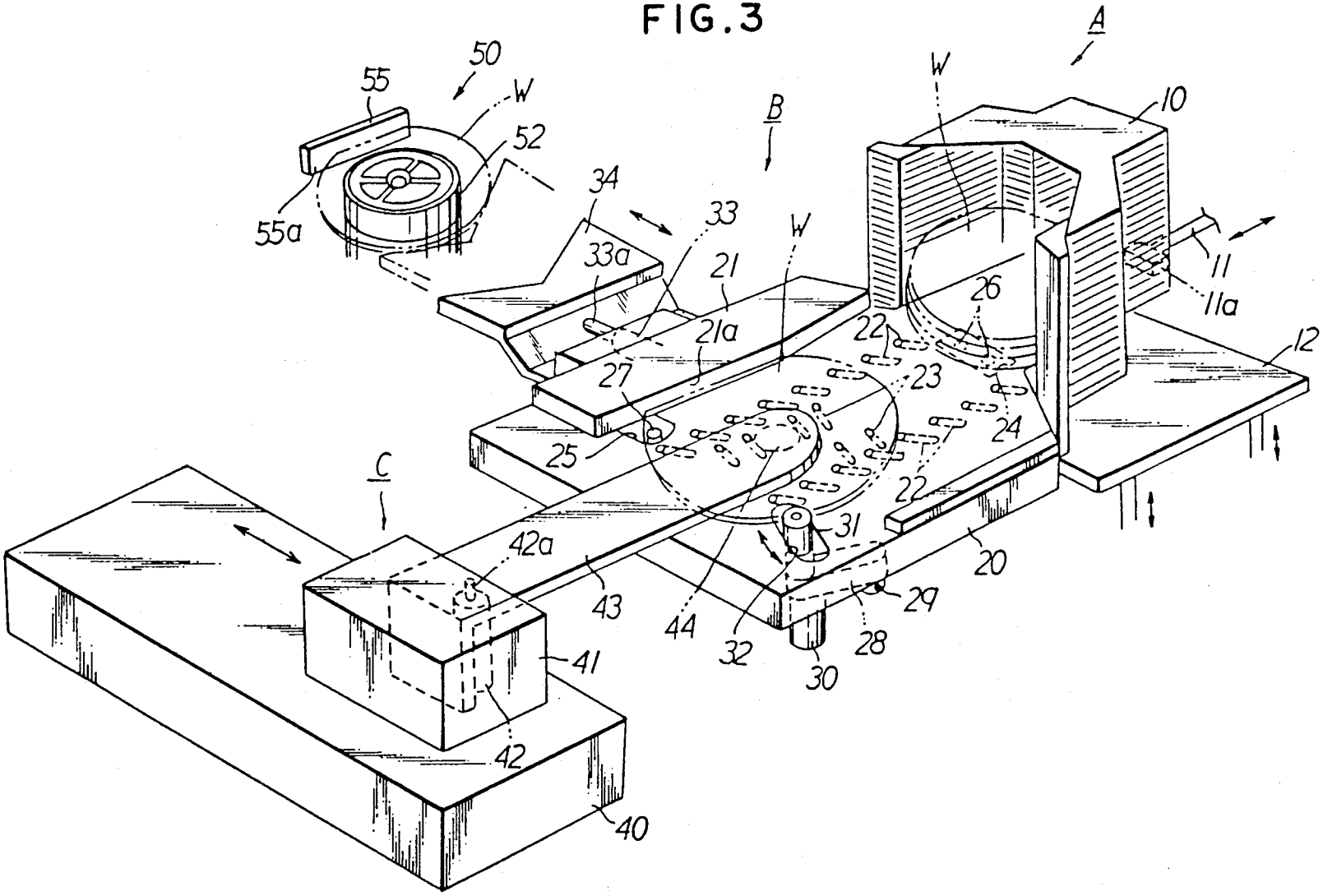
FIG. 3 is a perspective view of an apparatus section including a wafer supply means, a wafer positioning and setting means, a first wafer transferring means and a first stage including a positioning plate.
Figures 4, 5:
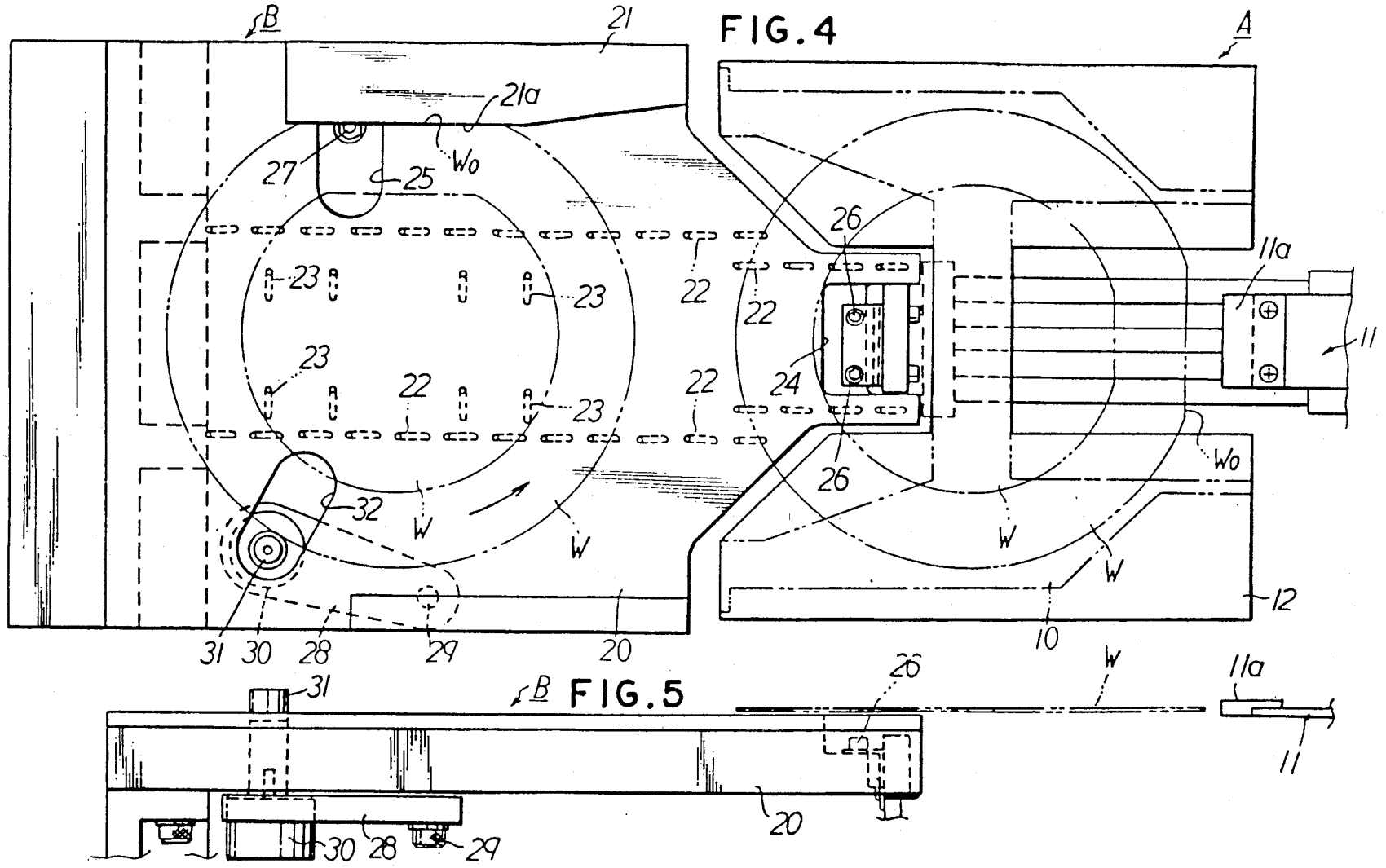
FIG. 4 is a plan view of an apparatus section including the wafer supply means and the wafer positioning and setting means.
FIG. 5 is a side view thereof.

First of all, the constructions of the wafer supply means A, wafer positioning and setting means B, and first wafer transferring means C will be described in detail with reference to FIGS. 3 to 5. FIG. 3 is a perspective view of the wafer supply means A, wafer positioning and setting means B and first wafer transferring means C, FIG. 4 is a plan view of the wafer supply means A and wafer positioning and setting means B, and FIG. 5 is a side view thereof.

The wafer supply means A includes a wafer supply cassette 10 and a pusher 11. The wafer supply cassette 10 is placed on a raising/lowering table 12. A plurality of wafers W, as the objects to be lowered, are stacked in the supply cassette 10, with one wafer suitably spaced apart from another, and the wafers are properly arranged in a specified direction with regard to orientation-flat portions. At the back (the right side in the Figure) of the supply cassette 10 there is provided the pusher 11, which is caused to make its stroke movement back and forth (in the arrow-indicated direction in FIG. 3) by a driving means such as an air cylinder (not shown). The pusher 11 is mounted, at its fore end, with a pusher plate 11*a*. The raising/lowering table 12 is raised and lowered by a driving means (not shown).

The wafer positioning and setting means B has a guide plate 20 of relatively great thickness, which is disposed in front of (the left side in the Figure) the supply cassette 10. At one sideward portion of the guide plate 20, there is provided a positioning plate 21, which has a positioning surface 21*a* extending in parallel with the direction of supply (the right-and-left direction in FIG. 4) of the wafer W. The guide plate 20 is provided with a plurality of first air holes 22 and a plurality of second air holes 23, the first air holes 22 being obliquely formed in the frontward direction (the direction of supply of the wafer W), the second air holes 23 being obliquely formed toward the positioning plate 21. Note that the first air holes 22 and the second air holes 23 are connected to a compressed air supply source (not shown).

Optical sensors 26, and 27 are disposed at openings 24 and 25, respectively, which are formed in the guide plate 20 just before the supply cassette 10 and positioning plate 21, respectively. One end of a swing arm 28 is secured to the underside of a portion y guide plate 20, opposite to the positioning plate, and the other free end has a motor 30 fixed at the tip. A roller 31 is connected to a driving shaft of the motor 30 extending upwards therefrom. The roller 31 passes through an elliptical slot 32 formed in the guide plate 20 and projects upwardly therefrom.

Meanwhile, at the sideward portion of the guide plate 20, as shown in FIG. 3, there is disposed an air cylinder 33 having a rod 33*a*. The rod 33*a* is adapted to advance and retreat in a direction intersecting the direction of supply or transfer of the wafer W at right angles, the fore end of the rod 33*a* being mounted thereon with a pusher plate 34. Thus, the air cylinder 33 and the pusher plate 34 constitute a pusher for positioning the wafer W.

The first wafer transferring means C, shown in FIG. 3, includes a transferring frame 40 and a moving frame 41, which both move along the arrow-indicated direction, and an air cylinder 42 equipped with the moving frame 41. Air cylinder 42 has a rod 42*a* extending upwards therefrom. At the end of rod 42*a* a base end portion of a transferring arm 43, horizontally extending toward the wafer positioning and setting means B is supported transferring arm 43 has a free end which is provided with an suction portion 44 adapted to suck the wafer W. The suction portion 44 is connected to a vacuum source (not shown).

Figure 6:
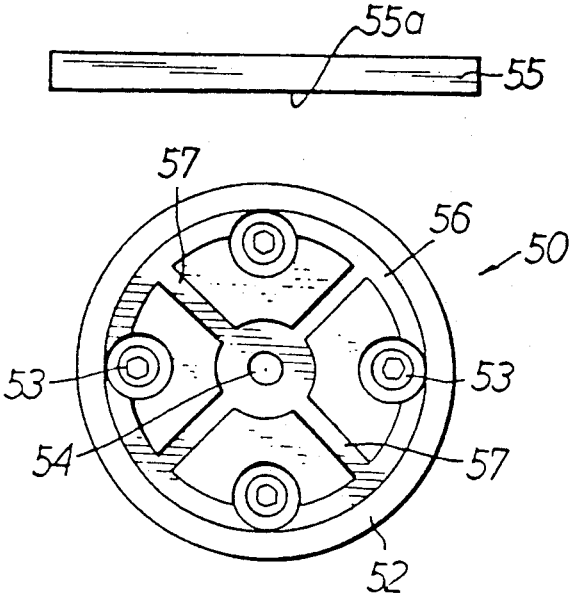
FIG. 6 is a plan view of a first working stage including the positioning plate.

Next, the construction of the orientation-flat portion chamfering means D will be described in detail with reference to FIGS. 6 to 9. FIG. 6 is a plan view of a first working stage, FIG. 7 is a sectional side view thereof, FIG. 8 is a perspective view of an orientation-flat portion working head, and FIG. 9 is a plan view thereof.

Figure 7:
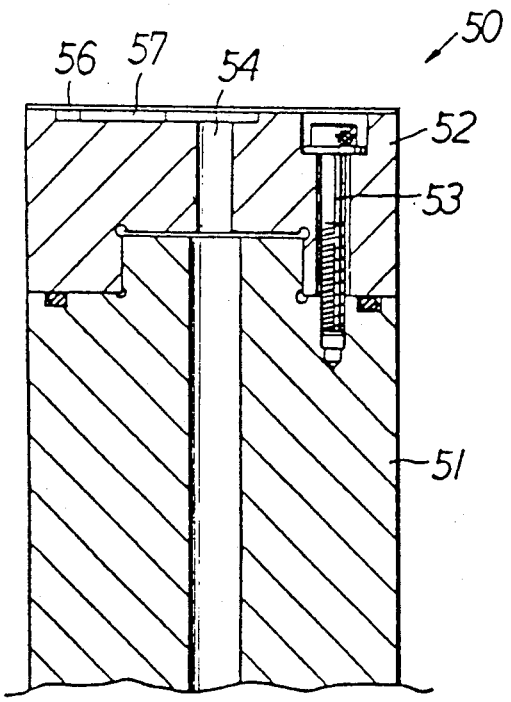
FIG. 7 is a side sectional view thereof.
Figure 8:
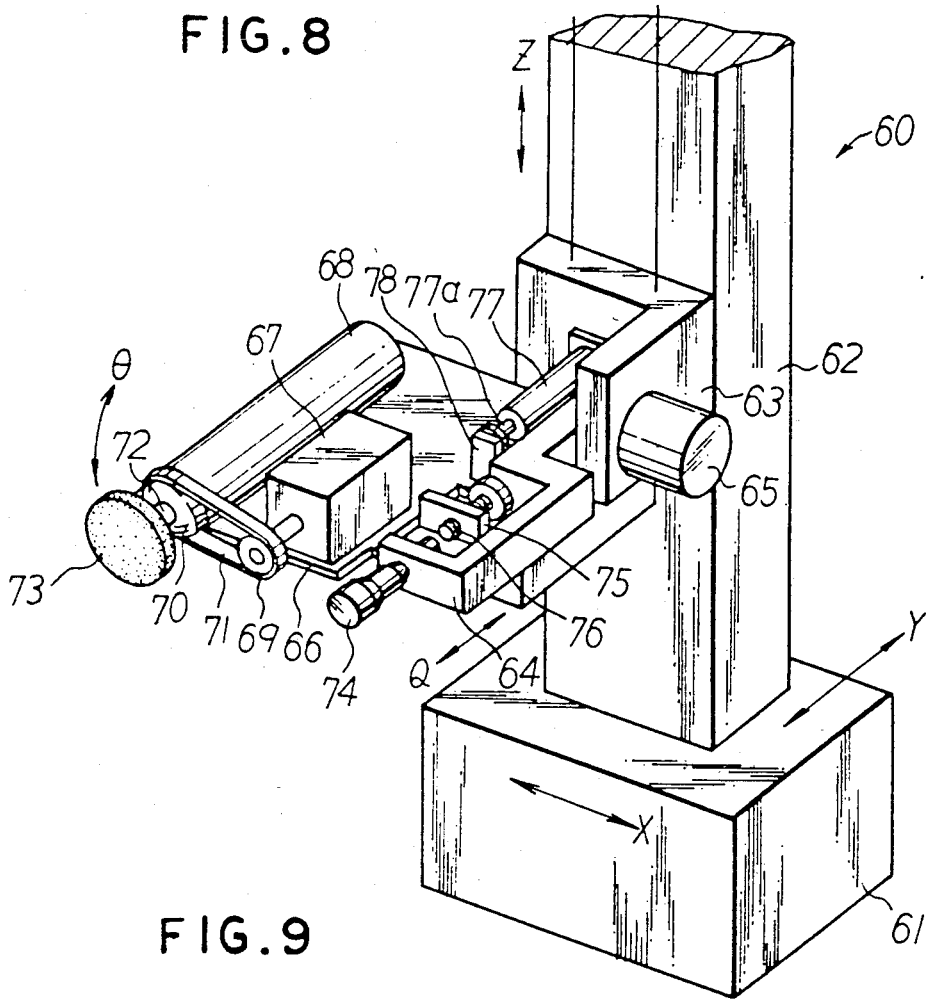
FIG. 8 is a perspective view of an orientation-flat portion working head.
Figure 9:
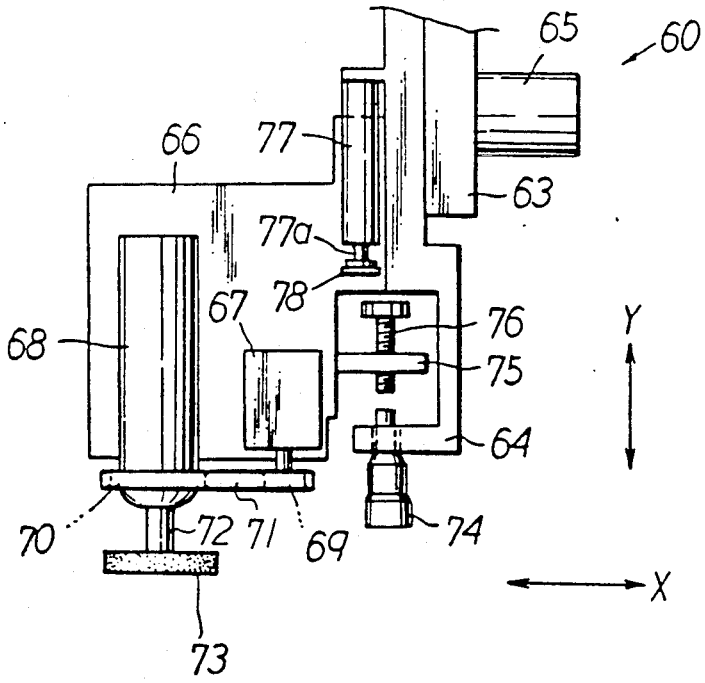
FIG. 9 is a plan view thereof.

The orientation-flat portion chamfering means D is constructed with a first working stage 50 shown in FIGS. 6 and 7 and an orientation-flat portion working head 60 shown in FIGS. 8 and 9.

The first working stage 50 is constructed such that a circular suction pad 52 is coupled to an upper end of a rotating shaft 51 by means of bolts 53. Each of the rotating shaft 51 and suction pad 52 is provided, at its center, with a suction bore 54 in such a manner that this suction bore is passed therethrough. At the side of the suction pad 52 is disposed a positioning plate 55, which has a flat positioning surface 55*a*. The suction bore 54 is connected to a vacuum source (not shown). Further, the rotating shaft 51 is driven to rotate about its axis by means of a rotating means (not shown).

The suction pad 52 is formed, in its upper surface, with a circular groove 56, which is allowed to communicate with the suction bore 54 by way of a plurality of radial grooves 57.

On the other hand, the orientation-flat portion working head 60 includes a main moving frame 61 which is movable in the X- and Y-directions, and on which a supporting frame 62 is vertically erected. On this supporting frame 62 is further supported a moving sub-frame 63 in such a manner that this sub-frame is movable in the Z-direction (vertical direction) along the length of the supporting frame 62. A swing frame 64 is mounted on the sub-frame 63 in such a manner that the swing frame 64 is swingable about its base end portion in the direction indicated by $\theta$. It should be noted that the angle of inclination to the Y-direction of that swing frame 64 is adjusted by a pulse motor 65 mounted on the sub-frame 63.

A slide base 66 is supported by the swing frame 64 in such a manner that the slide base is slidable in the direction indicated by character Q in FIG. 8. A motor 67 and a spindle 68 are juxtaposed with each other on the slide base 66. Further, an air cylinder 77 is secured to the swing frame 64 and is connected, by way of a foremost end of a rod 77*a*, to a plate 78 erected on the slide base 66, thereby enabling a fine adjustment of the position of a grinding wheel 73 in the Q direction. An endless belt 71 is stretched between a pulley 69 and a pulley 70, the pulley 69 being fitted to an end of a driving shaft of the motor 67, and the pulley 70 being fitted to the spindle 68. The grinding wheel 73 is mounted on an end portion of a driving shaft 72 extending from the spindle 68. Accordingly, the position of the grinding wheel 73 is controlled through five positioning movements in, i.e., each of the X-, Y-, and Z-axes of three-dimensional rectangular coordinates, the angle $\theta$ of rotation, and the Q-direction.

On the other hand, a micrometer 74 is mounted on the fore end portion of the swing frame 64. A bracket 75 is provided to project from the slide base 66. A stop screw 76, which opposes the micrometer 74, is screwed through the bracket 75 in such a manner that the stop screw 76 may be allowed to advance forwards or retreat backwards.

Next, the constructions of the second transferring means E and the third transferring means G will be described with reference to FIGS. 2 and 10.

Figures 10, 11:
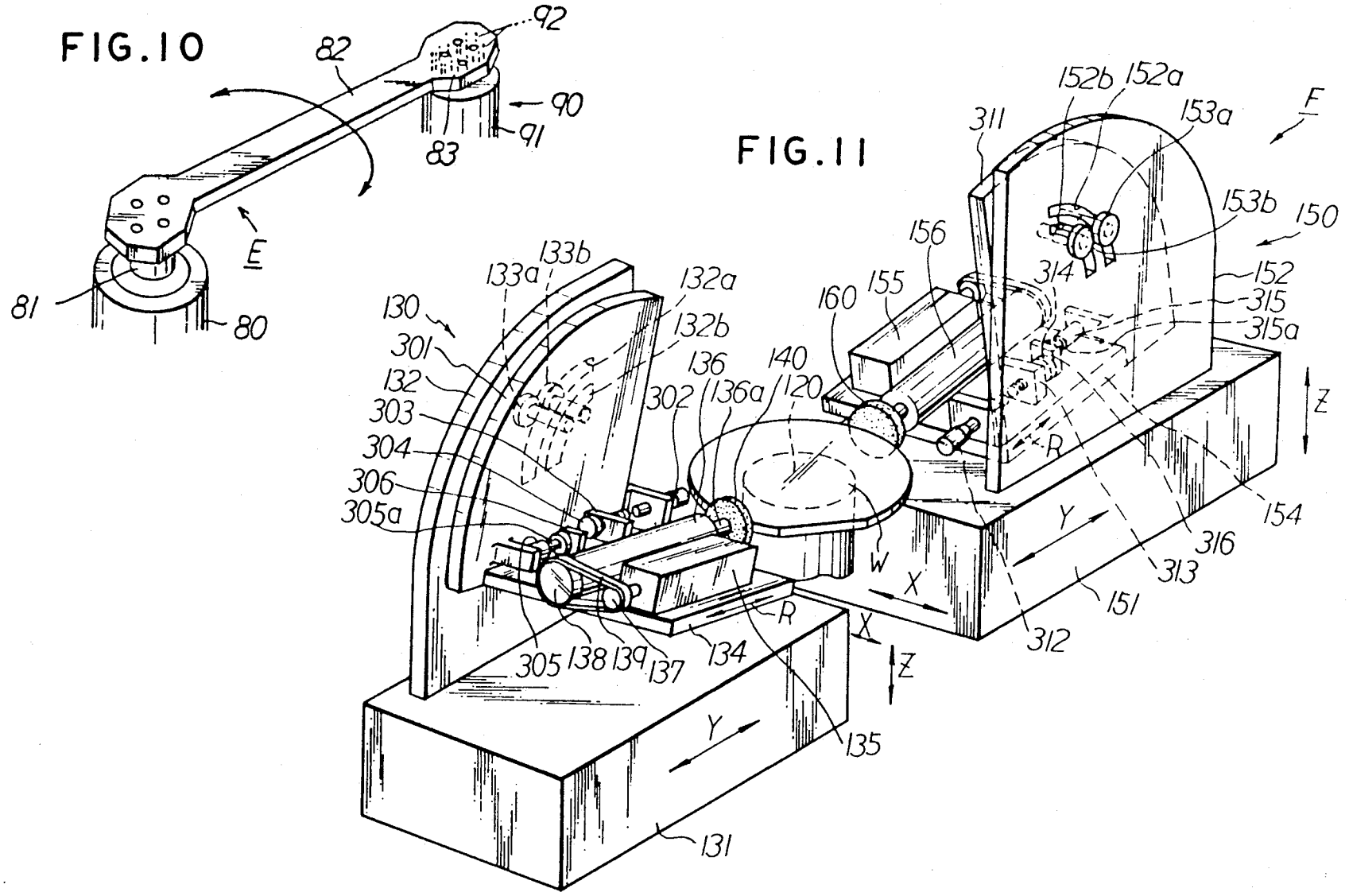
FIG. 10 is a perspective view of a second transferring means.
FIG. 11 is a perspective view of an outer periphery working means.

More specifically, FIG. 10 is a perspective view of the second transferring means E. This means E includes a driving means 80 having a shaft 81, and a transferring arm 82 having one end connected to the shaft 81. As shown in FIG. 2, the transferring arm 82 is adapted to horizontally rotate about the shaft 81 between the first working stage 50 of the orientation-flat portion chamfering means D and a second working stage 120 of the outer circular periphery chamfering means F. The fore end portion of the transferring arm 82 is provided, at its underside, with a vacuum suction portion 83. At a middle position between the first working stage 50 and the second working stage 120 and on a circular arc locus described by the vacuum suction portion 83 of the transfer arm 82 there is installed a cleaning unit 90 which is intended to clean the vacuum suction portion 83. The cleaning unit 90 includes a rotating shaft 91, on which are provided brushes 92, as shown in FIG. 10.

The third transferring means G is constructed in the same manner as in the case of the second transferring means E. The third transferring means G also includes a transferring arm 102 and a driving means 100 having a shaft 101. The transferring arm 102 of the third transferring means G is adapted to horizontally rotate about the shaft 101 of the driving means 100 shown in FIG. 2 between the second working stage 120 and an inversion stage 170 of the wafer inversion means H, or between the second working stage 120 and a water chute 200 of the wafer recovering means I. The transferring arm 102 has a fore end portion, on the underside of which there is provided a vacuum suction portion 103. At a middle position between the second working stage 120 and the inversion stage 170 and on a circular arc locus described by the vacuum suction portion 103 of the transferring arm 102 there is installed a cleaning unit 110 which is intended to clean the vacuum suction portion 103.

Next, the construction of the outer circular periphery working or machining means F will be described below with use of FIG. 11 which is a perspective view of the outer circular periphery machining means F.

The outer circular periphery machining means F include the second working stage 120, and outer circular periphery working heads 130, 150 which are disposed in such a manner that both the heads oppose each other with the second working stage 120 interposed therebetween. Since the construction of the second working stage 120 is the same as that of the first working stage 50, description thereof is omitted.

One outer circular periphery working head 130 has a moving frame 131 which is movable in the three directions of the illustrated X-, Y-, and Z-axes. On moving frame 131, there is vertically erected a supporting plate 132, which has circular-arc like guide slots 132*a*, 132*b*, through which fixing screws 133*a*, 133*b* are passed, respectively. By the use of fixing screws 133*a*, 133*b*, a rotary vertical plate 301 is fixedly mounted on the supporting plate 132. A slide base 134 is attached to the rotary vertical plate 301 in such a manner that the slide base 134 is freely slidable in the R-indicated direction. A motor 135 and a spindle 136 are juxtaposed with each other on the slide base 134. An endless belt 139 is stretched between a pulley 137 and a pulley 138, the pulley 137 being fitted to the end of a driving shaft of the motor 135, and the pulley 138 being fitted to the end of a drive shaft of the spindle 136. A grinding wheel 140 is mounted on the end of a driving shaft 136*a* extending from the spindle 136 in the R-indicated direction. Further, a micrometer 302 is mounted on the slide base 134. In addition, a stop screw 304, which opposes micrometer 302, is screwed through a bracket 303 planted on the slide base 134, in such a manner that the stop screw 304 is allowed to advance or retreat. An air cylinder 305 is fixedly mounted on the rotary vertical plate 301. A rod 305*a* extends from the air cylinder 305 in such a manner that the rod 305*a* is allowed to freely advance or retreat in the R direction the rod 305*a* has a fore end which is connected to a plate 306 erected on the slide base 134.

The fixing screws 133*a*, 133*b* can be loosened and moved along the guide slots 132*a*, 132*b*, so that the angle of inclination to the Y-direction of the slide base 134 is slidably adjusted and then the fixing screws can be tightened. Thus, the angle of inclination to the wafer main surfaces of the grinding wheel 140 driven to rotate by the spindle 136 installed on the slide base 134 will also be changed relative to the horizontal plane. It is to be noted, in this connection, that if the moving frame 131 is moved in the respective directions of X-, Y-, and Z-axes, the position of the grinding wheel 140 determined in the respective directions of X-, Y-, and Z-axes will also be changed.

Since the construction of the other outer circular periphery working head 150 is completely the same as that of the above-described outer circular periphery working head 130, any further description thereof is omitted. However, in the Figure, reference numeral 151 denotes a moving frame, 152 denotes a supporting plate, 152*a*, 152*b* denote guide slots, 153*a*, 153*b* denote fixing screws, 154 denotes a slide base, 155 denotes a motor, 156 denotes a spindle, 160 denotes a grinding wheel, 311 denotes a rotary vertical plate, 312 denotes a micrometer, 313 denotes a bracket, 314 denotes a stop screw, 315 denotes an air cylinder, 315*a* denotes a rod, and 316 denotes a plate.

Figure 12:
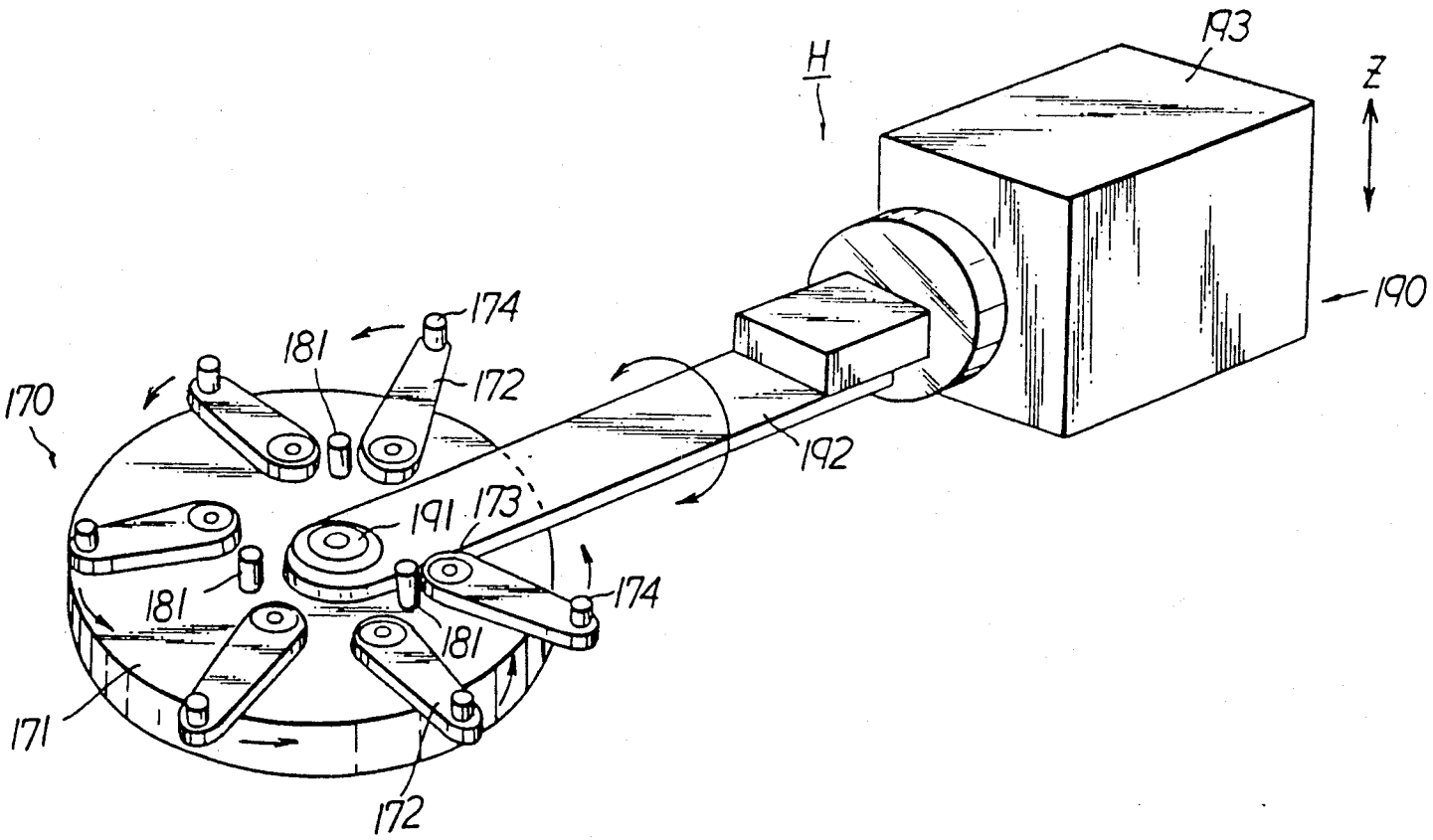
FIG. 12 is a perspective view of a wafer inversion means.
Figure 13:
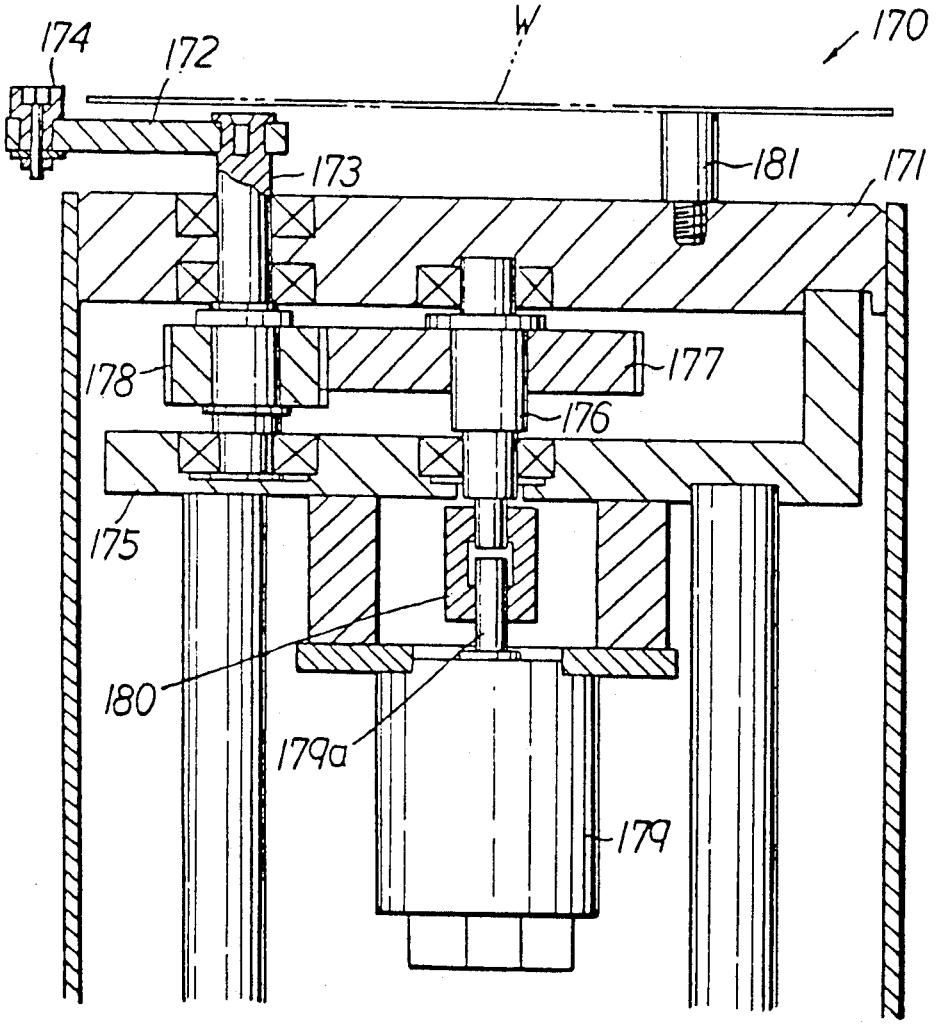
FIG. 13 is a vertically sectional view of the inversion stage.
Figure 14:
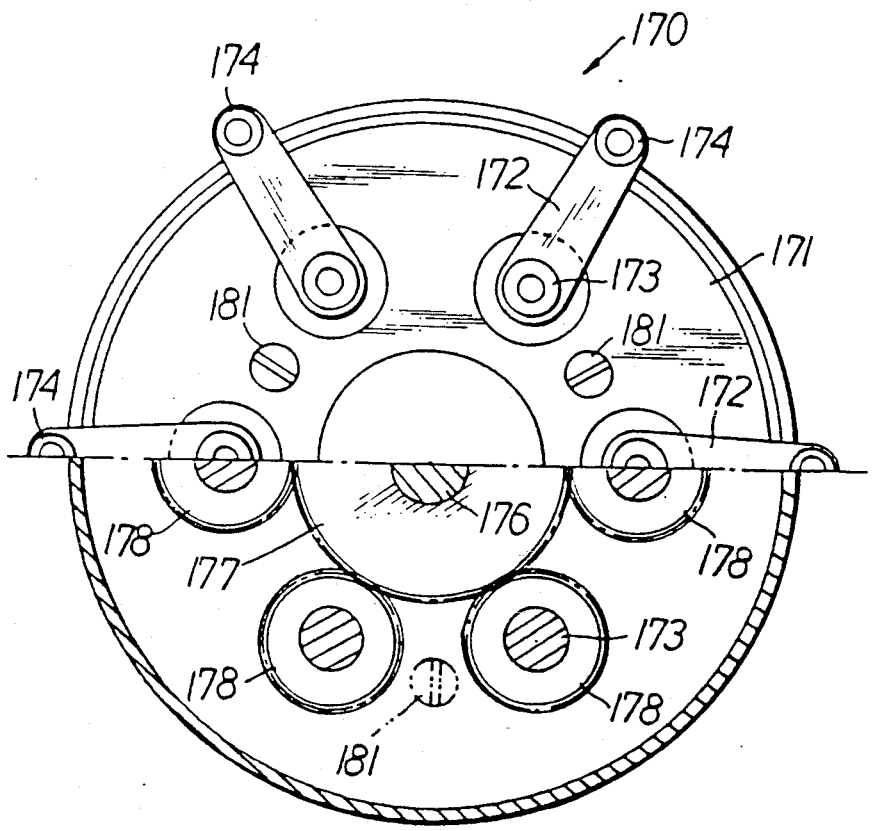
FIG. 14 is a plan view, half in section, of the inversion stage shown in FIG. 13.

Next, the construction of the wafer inversion means H will be described below in detail with reference to FIGS. 12 to 14. FIG. 12 is a perspective view of the wafer inversion means H, FIG. 13 is a vertically sectional view of the inversion stage 170, and FIG. 14 is a plan view, half in section, of the inversion stage 170. Inversion means H includes the inversion stage 170 and an inversion unit 190.

The inversion stage 170 has a centering function for centering the wafer W. The centering function includes six positioning arms 172 of equal length which are at first radially disposed on a circular disc 171 and which are each rotatable. That is, the fixed axes of six rotating shafts 173 are disposed on the same circle line of the circular disc 171 at equiangular pitches (60° angle pitch). As shown in FIG. 13, each rotating shaft 173 is vertically positioned and an upper end thereof is projected upwardly above the circular disc 171. To the upper end portion of the rotating shaft 173 is coupled an inner end portion of the corresponding positioning arm 172. On an outer end portion of the positioning arm 172 extending horizontally outwardly in the radial direction is mounted a corresponding roller 174 adapted to press inwardly the wafer at its outer periphery.

Below the circular disc plate 171 is disposed a frame 175, and, as shown in FIG. 13 as well, between the centers of the circular disc plate 171 and the frame 175 is rotatably and vertically supported a rotating shaft 176. A center gear 177 of large diameter is fitted on that rotating shaft 176. A gear 178 of small diameter, shown in FIG. 14 is fitted on the rotating shaft 173, and is meshed with the center gear 177.

The rotating shaft 176, as shown in FIG. 13, is connected, via a coupling 180, to a driving shaft 179*a* of a motor 179 securedly disposed below the frame 175.

On the other hand, on the upper surface of the circular disc 171 are erected three supporting pins 181 for supporting the wafer W, pins 181 may be disposed on the same circle at equiangular pitches (120° angle pitch).

The inversion unit 190, as shown in FIG. 12, includes an inversion arm 192 having a fore end portion provided with a suction portion 191, and an operation frame 193 adapted to horizontally support the inversion arm 192 and invert the same upside down and cause it to move in the vertical direction (in the illustrated direction of the Z-axis).

Figure 15:
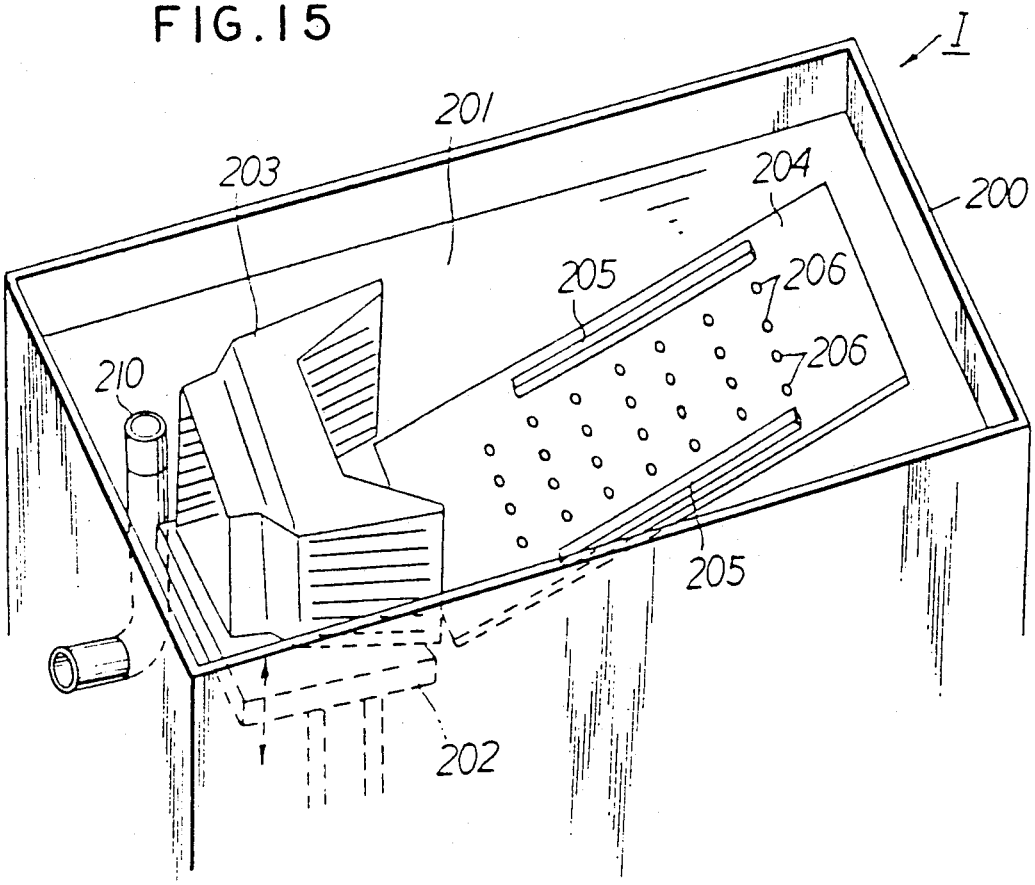
FIG. 15 is a perspective view of a wafer recovering means.
Figure 16:
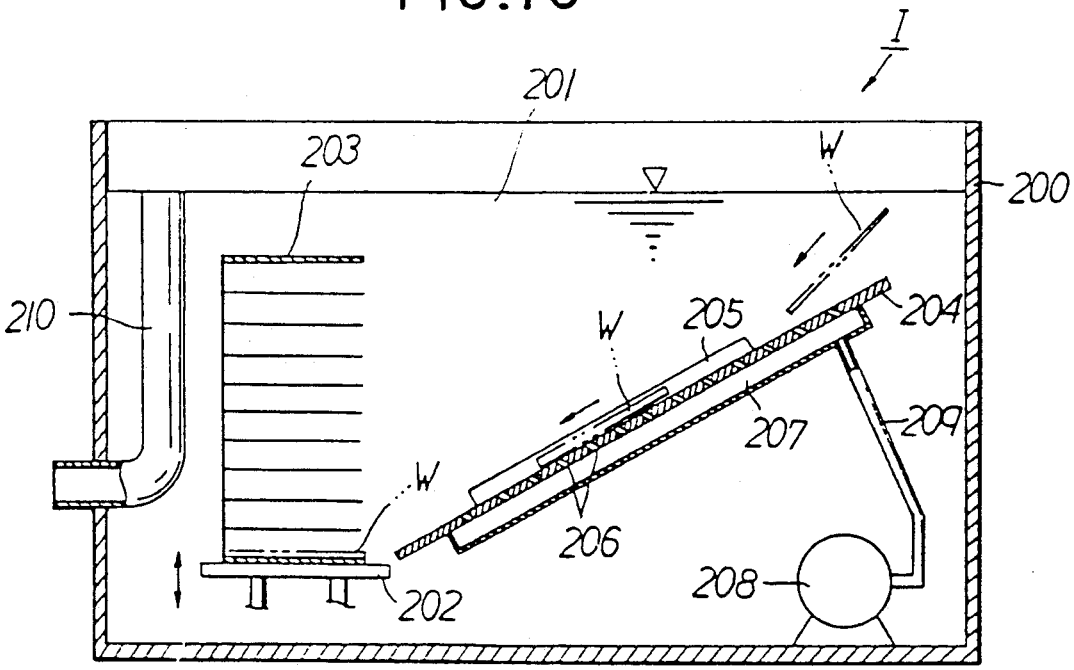
FIG. 16 is a side sectional view of the wafer recovering means.

Finally the construction of the wafer recovering means I will be described in detail with reference to FIGS. 15 and 16. FIG. 15 is a perspective view of the wafer recovering means, and FIG. 16 is a side sectional view thereof.

The wafer recovering means I includes a water chute 200 shaped like a vessel whose top is opened, the water chute 200 accommodating water 201 therein. In water 201 there are disposed a wafer receiving cassette 203 placed on an upwardly/downwardly movable table 202, and a guide plate 204 inclined or tilted obliquely and downwardly toward the wafer receiving cassette 203.

The wafer receiving cassette 203 is constructed in the same manner as that in which the wafer supply cassette 10 is constructed. The wafer receiving cassette 203 is intended to accommodate the wafers W having finished all the chamfering operations in such a manner that those wafers are sequentially stacked from below toward above and thus received.

On opposite side edges of the guide plate 204, there are provided two guide pieces 205, 205, respectively, which are used to guide the wafer W to the wafer receiving cassette 203, the two guide pieces being in parallel with each other. A plurality of water jetting holes 206 are bored in the portion of the guide plate 204 between those guide pieces 205 and 205. Formed on the underside of the guide plate 204 is a flow passage 207, to which there is connected a pipe 209 led from a water pump 208 installed within the water chute 200. It is to be noted that the water chute 200 is provided with a pipe 210 for adjusting the level of the water.

The automatically wafer-chamfering method will now be described in detail while reference is being made to the function of the automatically wafer-chamfering apparatus.

Firstly, as shown in FIGS. 2 and 3, the wafer supply cassette 10 in which a number of wafers W—are stacked and received is set on the raising/lowering table 12 while, on the other hand, an empty cassette 203 for receiving the wafer W is set on the upwardly/downwardly movable table 202 shown in FIGS. 15 and 16. When, under this condition, a start button of the operation box 3 shown in FIG. 1 is pushed, the pusher 11 is forwardly moved to push out the lowest wafer W in the wafer supply cassette 10 and supply it onto the guide plate 20 of the wafer positioning and setting means B. When supply of this wafer W onto the guide plate 20 has been detected by the optical sensors 26, 26 provided thereon, the raising/lowering table 12 is lowered by a specified length or height. Thus, preparation is made for supply of the next wafer W onto the guide plate 20 by means of the pusher 11 in the same manner. Thereafter, the same operation is repeatedly carried out, whereby the wafers W in the wafer supply cassette 10 are sequentially supplied from below onto the guide plate 20 one after another.

Figure 17:
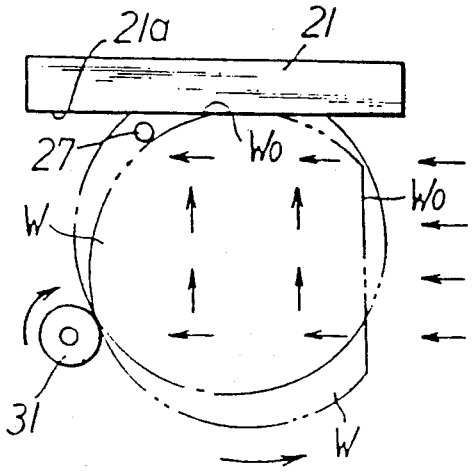
FIG. 17 is a plan view for explaining the principle in which a wafer is positioned at the first stage.

The wafer W which has been supplied onto the guide plate 20 as mentioned above is transferred on the guide plate 20 leftwardly of FIG. 4 by the pressure of the compressed air jetted from the first air holes 22 formed in the guide plate 20. When that wafer W has abutted on the rotary roller 31 shown in FIGS. 3 to 5, transfer thereof in said direction is stopped. Thus, the wafer W is rotated in the arrow-indicated direction in FIG. 17 by the rotary roller 31 driven to rotate by the motor 30. Incidentally, FIG. 17 is a plan view for explaining the principle of positioning the wafer W. At the same time that the wafer W starts to be driven to rotate as mentioned above, the wafer W is urged toward the positioning plate 21 by receiving the pressure of the compressed air jetted from the second air holes 23 formed in the guide plate 20. At the time when the orientation-flat portion Wo thereof has been caused to abut on the positioning surface 21*a* of the positioning plate 21, rotation of the wafer W is stopped. At this point, positioning of the wafer W is completed, and the orientation-flat portion Wo thereof is properly arranged in a predetermined direction. Upon completion of the wafer W positioning, the optical sensor 27 provided on the guide plate 20 is covered by the wafer W, so that the sensor 27 detects the completion of the wafer W positioning. Whereby, the rotation of the motor 30 is stopped and, at the same time, rotation of the roller 31 also is stopped. It is to be noted that if the bolt 29 shown in FIGS. 4 and 5 is loosened and the swing arm 28 is swung about the bolt 29 and the roller 31 attached onto the fore end thereof is moved within the slot 32, the wafer positioning and setting means B would be able to cope with differences in wafer size.

When the optical sensor 27 has detected completion of the wafer W positioning as mentioned above, the air cylinder 42 of the first wafer transfer means C is driven with the result that the transfer arm 43 is lowered. The transferring arm 43 thus lowered sucks and holds the wafer W positioned on the guide plate 20, by way of the suction portion 44 provided at the fore end of the transferring arm 43. Thereafter, the transferring arm 43 is raised by the operation of the air cylinder 42. Then, the moving frame 41 moves on the transferring frame 40 toward the first working stage 50 of the orientation-flat portion chamfering means D. That is, the transferring arm 43 also moves in the same direction while holding the wafer W. When the wafer W has been located above the first working stage, movement of the moving frame 41 is stopped and the air cylinder 42 is again driven, whereby the transferring arm 43 is lowered. Thereafter, suction of the wafer W by the suction portion 44 of the transferring arm 43 is released, so that the wafer W is placed on the suction pad 52 (see FIGS. 6 and 7) of the first working stage 50. The transferring arm 43 is then again moved upwards and thus retreated. Thereafter, the air cylinder 33 of the wafer positioning and setting means B is driven to operate. The pusher plate 34 is thereby delivered toward the suction pad 52 as indicated by two-dot chain lines in FIG. 3. Thus, the pusher plate 34 causes the wafer W on the circular suction pad 52 to be pressed against the positioning plate 55 and causes the orientation-flat portion Wo to evenly contact against the positioning surface 55*a* of the positioning plate 55, thus causing the wafer W to be positioned on the suction pad 52. Upon completion of the wafer W positioning, the wafer W is sucked by vacuum on the suction pad 52 and is fixed. It is to be noted that the positioning plate 55 moves in synchronism with the operation of the working head 60 of the orientation-flat portion chamfering means D, and retreats from the first working stage 50 before starting of champering by the working head 60.

Upon completion of the wafer W fixing on the first working stage 50, the position of the grinding wheel 73 of the orientation-flat portion working head 60 shown in FIGS. 8 and 9 is controlled through the three-dimensional rectangular coordinate axis directions, the rotation angle $\theta$, and the Q-direction as mentioned before, whereby the orientation-flat portion Wo is chamfered by the grinding wheel 73 driven to rotate. Namely, when the motor 67 on the slide base 66 is driven to rotate, this rotation is transmitted to the spindle 68 via the pulley 69, belt 71 and pulley 70, whereby the driving shaft 72 of the spindle 68 is driven to rotate, whereby the grinding wheel 73 fitted thereto is caused to rotate. Then, the air cylinder 77 is driven to operate to urge the slide base 66 toward the wafer W. Thereafter, if the main frame 61 is reciprocatingly moved along the X-axis in FIG. 8 in a state wherein the grinding wheel 73 is pressed, under a predetermined pressure, against the orientation-flat portion Wo of the wafer W, the grinding wheel 73 is moved while kept rotated in the direction of the X-axis as indicated in the plan view of FIG. 18. As a result, the orientation-flat portion Wo of the wafer W is chamfered by the operation of the grinding wheel 73. Note that the slide base 66, air cylinder 77 and the like constitute a uniform-pressure grinding mechanism for causing the grinding wheel 73 to be pressed against the orientation-flat portion Wo of the wafer W under a fixed or uniform level of pressure. This mechanism is arranged such that when an excessive pressure or force has acted on the wafer W, the slide base 66 is retreated, or moved backwards. Therefore, it is possible to prevent a local increase in contact pressure of the wafer against the grinding wheel due to mis-centering of the wafer W, to prevent a local excessive grinding due to such local increase in contact pressure, and further to prevent the occurrence of cracking or chipping of the wafer W due to the excessive pressing of the grinding wheel 73 against the wafer W.

Figure 19:
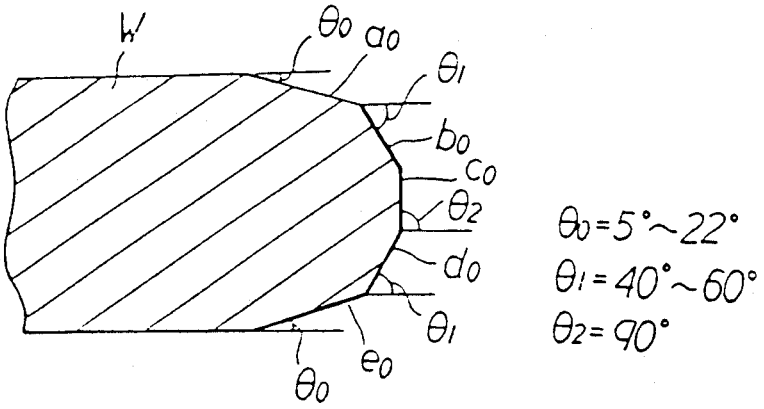
FIG. 19 is a sectional view taken along the line J—J of FIG. 18.

By the way, the orientation-flat portion Wo of the wafer W is chamfered in regard to five surfaces $a_o$, $b_o$, $c_o$, $d_o$, and $e_o$ having respectively different angles of inclination, as shown in FIG. 19. Chamfering of these five surfaces $a_o$, $b_o$, $c_o$, $d_o$ and $e_o$ is sequentially performed by changing the angle of inclination of the grinding wheel 73 relative to the orientation-flat portion Wo. In this concern, the angle of inclination of the grinding wheel 73 is changed by changing the angle of inclination of the swing frame 64 through operation of the pulse motor 65. It should be noted that FIG. 19 is a sectional view taken along the line J—J of FIG. 18. And the angle $\theta$ of inclination of the $a_o$ and $e_o$ surfaces relative to one of the main surfaces of a wafer, the angle $\theta_1$ of inclination of the $b_o$ and $d_o$ surfaces relative to one of the main surfaces, and the angle $\theta_2$ of inclination of the $c_o$ surface relative to one of the main surfaces are set at 5 to 22°, 40° to 60°, and 90°, respectively.

When sequentially chamfering the surfaces $a_o$, $b_o$, $c_o$, $d_o$ and $e_o$ while sequentially changing the angle of inclination of the grinding wheel 73 as mentioned above, at the time when the chamfering operation is shifted from one surface to another, the grinding wheel 73 is once retreated from the orientation-flat portion Wo of the wafer W. In this case, unless the movement or shift of the grinding wheel 73 in the direction of the Y-axis (depth of cut) is regulated, opposite ends of the orientation-flat portion Wo would be ground inconveniently.

In this embodiment, however, there is provided a cutting depth regulating mechanism constituted by the micrometer 74 and the stop screw 76, the mechanism being arranged such that the movement of the grinding wheel 73 in the direction of the Y-axis (cutting operation) is regulated or limited by positioning of the stop screw 76 against the micrometer 74. For this reason, the above-mentioned inconvenience does not occur. Incidentally, by changing the distance between the micrometer 74 and the stop screw 76 by use of the micrometer 74, the depth of cut of the wafer W by the grinding wheel 73 is precisely adjusted.

When chamfering of the orientation-flat portion Wo of the wafer W is completed in the above-mentioned way, the outer circular peripheral surface (the c surface in FIG. 20) of the wafer excluding the orientation-flat portion Wo thereof is ground by the same grinding wheel 73 while the wafer W is being rotated.

After the outer circular peripheral portion of the wafer W has finished its grinding, the suction settlement of the wafer W on the first working stage 50 is released and then the wafer W is transferred to the second working stage 120 of the outer circular periphery working means F by the second wafer transferring means E. At the same time, the next fresh wafer W is transferred to the first working stage 50 by the first transferring means C.

During a time period in which the transferring arm 82 of the second wafer transferring means E is out of operation, the arm 82 is allowed to stay above the cleaning unit 90 as shown in FIG. 2. At this time, the suction portion 83 thereof is cleaned by means of brushes 92 (see FIG. 10) of the cleaning unit 90 so as to prevent the wafer W to be sucked from being contaminated by the suction portion 83 of the transferring arm 82.

Thus, the wafer W having been transferred to the second working stage 120 by the second wafer transferring means E is sucked by vacuum on the second working stage 120 and thus is fixed thereon. Thus, the outer circular peripheral edge of the wafer W excluding the orientation-flat portion Wo thereof is chamfered by the outer circular periphery working heads 130 and 150.

Figure 20:
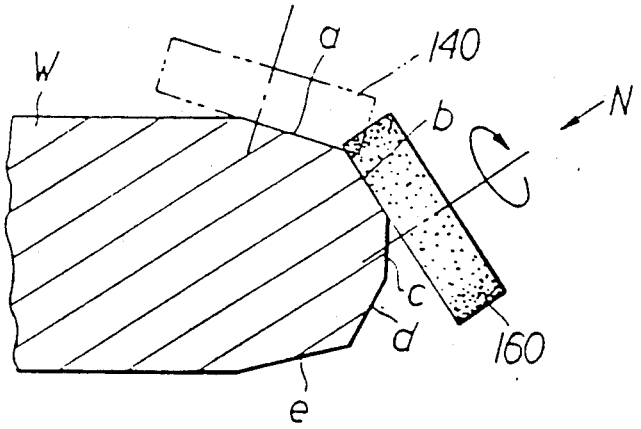
FIG. 20 is a sectional view taken along the line K—K of FIG. 18.
Figure 18:
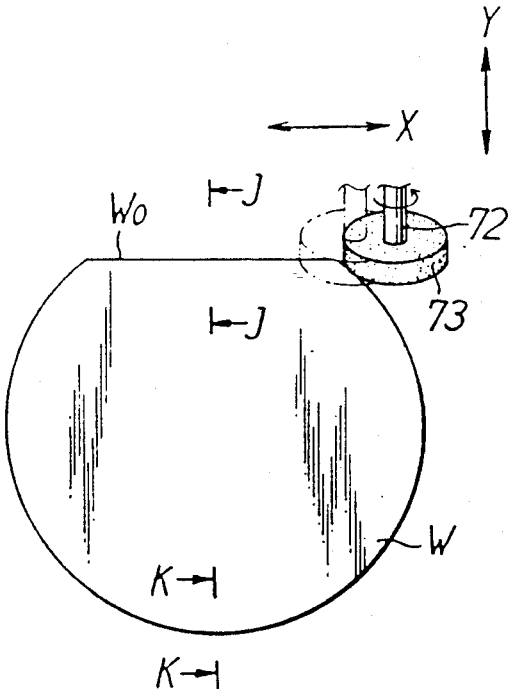
FIG. 18 is a plan view illustrating the manner in which the orientation-flat portion of a wafer is chamfered at the first stage.

The outer circular peripheral edge of the wafer W excluding the orientation-flat portion Wo thereof, is chamfered in regard to five surfaces a, b, c, d, and e having the same angles of inclination as in the case of the surfaces $a_o$ to $e_o$ (see FIG. 19) of the orientation-flat portion Wo, respectively, as shown in FIG. 20 (the sectional view taken along the line K—K of FIG. 18). That is, the wafer W is first chamfered by the two opposite outer circular periphery working heads 130, 150 while being rotated on the second working stage 120, in regard to the upper surface portions a and b of its outer circular peripheral edge. More specifically, in the outer circular periphery working head 130, when the motor 135 is driven to rotate, this rotation is transmitted to the spindle 136 via the pulley 137, belt 139, and pulley 138. As a result, the driving shaft **136*a* of the spindle 136 is driven to rotate with the result that the grinding wheel 140 secured thereto is rotated. Thus, the outer circular peripheral edge of the wafer W is chamfered at the surface portion a by the grinding wheel 140 inclined or tilted at a predetermined angle with respect to the wafer W. Also, the outer circular peripheral edge of the wafer W is similarly chamfered at the surface portion b by the grinding wheel 160 of the outer circular periphery working head 150**.

Figure 21:
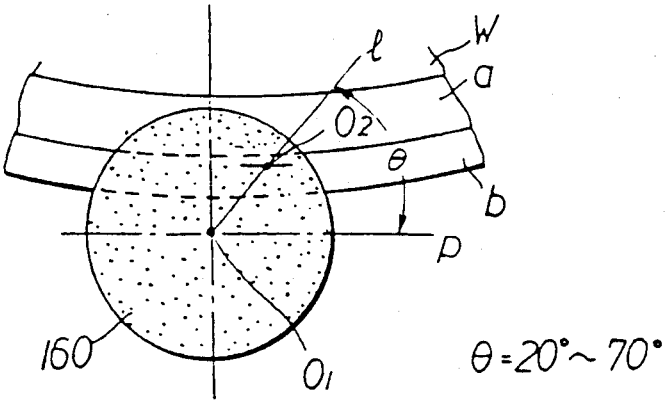
FIG. 21 is a view taken from the direction indicated by an arrow N in FIG. 20.

Incidentally, as mentioned before, each of the outer circular periphery working heads 130, 150, also, is provided with a uniform-pressure grinding mechanism for causing the grinding wheel 140 or 160 to be pressed against the wafer W under a specified level of pressure, as well as a cutting depth regulating mechanism for regulating the movement of the grinding wheel 140 or 160 in the direction of the arrow R. Meanwhile, FIG. 21 is a view taken from the direction indicated by the arrow N. For instance, if the grinding wheel 160 is used in a state wherein a straight line l connecting a rotational center $O_1$ of the grinding wheel 160 and a center $O_2$ of the portion (desired to be ground), where the grinding wheel 160 is in contact with the surface portion B to be chamfered, is inclined at an angle $\theta$ with respect to an axis P shown (the axis P is a line which is obtained by intersection of the surface of the grinding wheel and a plane parallel to the upper surface of the wafer, the intersection including the center of the grinding wheel), a good chamfered surface b would be obtained. Note that the angle $\theta$ is usually set to range between 20° and 70° inclusive. Furthermore, preferably the whole surface of the grinding wheel 140 or 160 is used for grinding operation by swinging movement thereof. BY so doing, it is possible to prevent the grinding wheel 140 or 160 from undergoing local abrasion, thereby elongating the service life thereof.

Upon completion of chamfering of the outer circular peripheral edge of the wafer in regard to the surface portions a and b, the wafer W on the second working stage 120 is transferred onto the inversion stage 170 of the wafer inversion means H by the third wafer transferring means G. Namely, suction settlement of the wafer W on the second working stage 120 is released while, on the other hand, the transferring arm 102 of the third wafer transferring means G is rotated up to the second working stage 120 by the driving means 100 thereof. Thereafter, the transferring arm 102 sucks and holds the wafer W by the suction portion 103 provided on its fore end portion. The transferring arm 102, thereafter, is again rotated. When the wafer W is moved up to the position over the inversion stage 170, the transferring arm 102 releases the suction of the wafer W to cause the wafer W to be placed on the supporting pins 181 of the inversion stage 170 shown in FIGS. 12 to 13. At this time, the fore end portion of the inversion arm 192 of the inversion unit 190 is fixedly located above the circular disc 171 and in the vicinity of the same in a state wherein the suction portion 191 is directed upwards as shown in FIG. 12. Thus, the inversion arm 192 sucks the wafer (not shown) from below the same. It is to be noted that when the transferring arm 102 is out of operation, it is allowed to stay on the cleaning unit 110 as shown in FIG. 2. During this staying period, the suction portion 103 provided at the fore end portion of the transferring arm 102 is cleaned by the cleaning unit 110.

Meanwhile, the inversion arm 192 rises upwards while the suction portion 191 at the fore end portion thereof is sucking the wafer W on the inversion stage 170. Then, the inversion arm 192 inverts the wafer W, or the wafer is turned upside down. Thereafter, the inversion arm 192 is again moved downwards to permit the wafer W to be placed on the supporting pins 181. Then, sucking of the wafer W by the suction portion 191 is released.

In the inversion stage 170, centering of the wafer W thus inverted is performed as follows. That is, when the motor 179, shown in FIG. 13, causes rotation of the rotating shaft 176, this rotation is transmitted to all the rotating shafts 173 by way of the center gear 177, gears 178, the rotating shafts 173 being rotated simultaneously in the same direction. Then, the positioning arms 172 of equal length which are fitted to the rotating shafts 173, also, are rotated simultaneously in the same direction. For this reason, the rollers 174 provided at the outer end portions of the positioning arms 172 are caused to equally press inwardly against the outer periphery of the wafer W, thereby centering the wafer W on the inversion stage 170.

Upon completion of the wafer W centering, the third wafer transferring means G is again driven to operate, whereby the wafer W on the inversion stage 170 is again transferred onto the second working stage 120 by the third wafer transferring means G. Namely, when the transferring arm 102 of the third wafer transferring means G sucks the wafer W by its suction portion 103, on the inversion stage 170, the positioning arms 172 are rotated in the opposite direction to that at the time of centering. In consequence, the pressing of the rollers 174 against the wafer W is released. Thereafter, the wafer W is sucked by the transferring arm 102 and then is transferred to the second working stage 120. At this time, the inversion arm 192 of the inversion unit 190 is lowered and stays under the condition illustrated in FIG. 12.

On the second working stage 120, the wafer W is sucked and fixed. Thus, the wafer W is chamfered by the outer circular periphery working heads 130, 150 while it is being rotated on the second working stage 120, in regard to the upper surface (the opposite surface to that which has the chamfered surface portions a and b) of its outer circular peripheral edge. Thus, the surface portions d and e shown in FIG. 20 are formed with respect to the outer circular peripheral edge of the upper wafer W surface. Incidentally, the surface portion c of the wafer W, shown in FIG. 20, has already been chamfered by the orientation-flat portion chamfering means D, as stated before. Further, rotary brushes not shown are provided above the first working stage 50 and the second working stage 120, respectively. When chamfering is completed on the first working stage 50 or the second working stage 120, the rotary brush is lowered to clean the upper surface of the first working stage 50 or the second working stage 120 together with water. Upon completion of the cleaning, the brush rises upwards. As a result, the contamination of the wafer W and the occurrence of scratching of the wafer W are effectively prevented.

Upon completion of the surface portions a, b chamfering, suction settlement of the wafer W on the second working stage 120 is released. Then, the wafer W is sucked by the transferring arm 102 of the third wafer transferring means G and is transferred to the water chute 200 of the wafer recovering means I. In this water chute 200, suction of the wafer W by the transferring arm 102 is released and thereafter the wafer W is allowed to drop into the water 201.

The wafer thus allowed to drop into the water 201 of the water chute 200 moves on the guide plate 204 toward the wafer receiving cassette 203 as shown in FIG. 16. At this time, the wafer W is compulsively transferred toward the wafer receiving cassette 203, wherein the wafer W is kept in a state of floating by the streams of water jetted from the water holes 206 bored in the guide plate 204. Thus, the wafer W is received into the wafer receiving cassette 203 from below in the sequential order. It is to be noted that the upwardly/downwardly movable table 202 having the wafer receiving cassette 203 supported thereon is lowered by a specified height each time the wafer W is received into the cassette 203. Thus, a plurality of wafers W having finished undergoing all the chamfering operations are received in the cassette 203 in such a manner that they are sequentially stacked upwards in the same.

As stated above, in the automatic wafer chamfering apparatus 1 in accordance with the present invention, since a series of steps including the above-mentioned supply of wafer, positioning and setting of wafer, chamfering of wafer, and recovery of wafer are carried out on a continuous and full-automatic basis, it is possible to achieve reduction in labor as well as enhancement in the operating efficiency and chamfer-processing ability.

In the above-described embodiment, the orientation-flat portion Wo and the outer peripheral edge of the wafer W are chamfered in regard to the five surface portions $a_o$ to $e_o$ shown in FIG. 19 and the five surface portions a to e shown in FIG. 20, respectively. The number of the surface portions desired to be chamfered is not limited thereto. For instance, where the surface portions to be chamfered increase more in number, the angles of inclination of the grinding wheels 73, 140 and 160 of the working heads 60, 130 and 150 in the first working stage 50 and the second working stage 120 may be changed in conformity with the angles at which the surface portions are to be chamfered. Alternatively, a plurality of working heads mounted in advance with grinding wheels at desired angles may be installed. Although, in the above-described embodiment, a grinding wheel is employed for the rotary working tool, a polishing or abrading buff may also be employed instead. That is, if such a buff is employed and the angle of inclination thereof relative to the wafer is made freely variable, it would be possible to shape the chamfered surface of the wafer into a continuous and curved one and, at the same time, to enhance the smoothness and machining precision of the chamfered surface.

Further, although, in the above-described embodiment, reference has been made to the chamfering of the wafer W having the orientation-flat portion Wo in particular, the method and apparatus in accordance with the present invention may of course be applicable to the wafer W having no orientation-flat portion. That is, where the wafer having no orientation-flat portion is chamfered, the wafer is transferred from the wafer supply cassette 10 shown in FIG. 2 directly to the first working stage 50 and is positioned on the same. And the outer circular peripheral end surface (the surface portion c in FIG. 20) alone of the wafer W is chamfered by the working head 60. Thereafter, the wafer may be processed in the same manner as in the preceding embodiment.

As will be apparent from the foregoing description, according to the present invention, a series of operations including supply of wafer, positioning and setting of wafer, chamfering of wafer, transfer of wafer, and recovery of wafer can be performed completely automatically. This brings about the advantage that it is possible to reduce the labor used, as well as to enhance the operating efficiency and the chamfer-processing ability.

What is claimed is:

1. An apparatus for automatically chamfering a wafer, said apparatus comprising:

wafer supply means for sequentially supplying a wafer one by one, wafer positioning and setting means for positioning said wafer thus supplied and setting it on working stages, said wafer positioning and setting means including a mechanism for causing an orientation-flat portion of said wafer to be properly arranged in a specified direction, said mechanism including a positioning plate having a positioning surface against which said orientation-flat portion of said wafer is to be evenly pressed, a roller for rotating said wafer by pressing inwardly against an outer peripheral edge of said wafer, and an urging means for causing said wafer to be urged toward and pressed against said positioning plate and said roller by jetting of a fluid, chamfer-machining means for chamfering said wafer thus positioned and set, wafer recovering means for recovering said wafer thus chamfered, and wafer transferring means or performing at least one transfer operation, said transfer operations including transferring said wafer from said wafer positioning and setting means to said chamfer-machining means and transferring said wafer from said chamfer-machining means to said wafer recovering means.

2. An apparatus for automatically chamfering a wafer, said apparatus comprising:

wafer supply means for sequentially supplying a wafer one by one, wafer positioning and setting means for positioning said wafer thus supplied and setting it on working stages, chamfer-machining means for chamfering said wafer thus positioned and set, said chamfer-machining means including said working stages each for causing said wafer to be sucked and fixed, and working tools and rotating means therefor, each working tool and a corresponding one rotating means therefor being adapted to oppose said wafer thus sucked and fixed and control means for controlling the position of said each working tool and corresponding one rotating means, relative to said wafer through their movement along axes of three-dimensional rectangular coordinates, their movement along a single straight line, and their rotation about one of said axes thereof, wafer recovering means for recovering said wafer thus chamfered, and wafer transferring means for performing at least one transfer operation, said transfer operations including transferring said wafer from said wafer positioning and setting means to said chamfer-machining means and transferring said wafer from said chamfer-machining means to said wafer recovering means.

3. An apparatus for automatically chamfering a wafer, said apparatus comprising:

wafer supply means for sequentially supplying a wafer one by one, wafer positioning and setting means for positioning said wafer thus supplied and setting it on working stages, chamfer-machining means for chamfering said wafer thus positioned and set, said chamfer-machining means being provided to chamfer said wafer having an orientation-flat portion and including an orientation-flat portion chamfering means and an outer circular periphery working means, each of which includes said working stage and at least one working head, wafer recovering means for recovering said wafer thus chamfered, and wafer transferring means for performing at least one transfer operation, said transfer operations including transferring said wafer from said wafer positioning and setting means to said chamfer-machining means and transferring said wafer from said chamfer-machining means to said wafer recovering means.

4. An apparatus for automatically chamfering a wafer, said apparatus comprising:

wafer supply means for sequentially supplying a wafer one by one, wafer positioning and setting means for positioning said wafer thus supplied and setting it on working stages, chamfer-machining means for chamfering said wafer thus positioned and set, wafer recovering means for recovering said wafer thus chamfered, and wafer transferring means for performing at least one transfer operation, said transfer operations including transferring said wafer from said wafer positioning and setting means to said chamfer-machining means and transferring said wafer from said chamfer-machining means to said wafer recovering means, said wafer transferring means including a transferring arm adapted to rotate about one end thereof, a suction portion provided at the other end of said transferring arm, a driving means for driving said transferring arm so as to rotate the same and a cleaning unit for cleaning said suction portion of said transferring arm.

5. The apparatus for automatically chamfering a wafer according to claim 1, said wafer supply means including a wafer supply cassette for receiving therein in such a manner that a plurality of wafers are stacked therein, a table a height adjustable having placed thereon said wafer supply cassette and causing said wafer supply cassette to be raised or lowered by a specified height with a specified timing, and a pusher for delivering said wafer one by one in said wafer supply cassette by making a stroke movement in interlocking relation with the movement of said height adjustable table.

6. The apparatus for automatically chamfering a wafer according to claim 1, said wafer positioning and setting means including a pusher for causing said wafer, which has been transferred onto its corresponding working stage of said chamfer-machining means, to be pressed against a positioning plate.

7. The apparatus for automatically chamfering a wafer according to claim 2, said wafer positioning and setting means including a mechanism for causing an orientation-flat portion of said wafer to be properly arranged in a specified direction, said mechanism including a positioning plate having a positioning surface against which said orientation-flat portion of said wafer is to be evenly pressed, a roller for rotating said wafer by pressing inwardly against an outer peripheral edge of said wafer, and an urging means for causing said wafer to be urged toward and pressed against said positioning plate and said roller by jetting of a fluid.

8. The apparatus for automatically chamfering a wafer according to claim 7, further comprising roller adjusting means for variably adjusting the position of said roller relative to said positioning plate.

9. The apparatus for automatically chamfering a wafer according to claim 3, said chamfer-machining means including said working stages each for causing said wafer to be sucked and fixed, and working tools and rotating means therefor, each working tool and a corresponding one rotating means therefor being adapted to oppose said wafer thus sucked and fixed and control means for controlling the position of said each working tool and corresponding one rotating means relative to said wafer through their movement along axes of three-dimensional rectangular coordinates, their movement along a single straight line, and their rotation about one of said axes thereof.

10. The apparatus for automatically chamfering a wafer according to claim 1, said chamfer-machining means being provided to chamfer said wafer having an orientation-flat portion and including an orientation-flat portion chamfering means and an outer circular periphery working means, each of which includes said working stage and at least one working head.

11. The apparatus for automatically chamfering a wafer according to claim 10, said working stage of said outer circular periphery working means being rotatable, said outer circular periphery working means including a plurality of said working heads with said working stage interposed therebetween, the angle of inclination of said working tool of one said working head with respect to said wafer being different from that of said working tool of another said working head.

12. The apparatus for automatically chamfering a wafer according to claim 9, said working head including a cutting depth regulating mechanism for regulating the amount of movement of said working tool toward said wafer, said mechanism including a micrometer and a stop screw adapted to abut thereagainst.

13. The apparatus for automatically chamfering a wafer according to claim 10, further comprising wafer transferring means for transferring said wafer from said orientation-flat portion chamfering means to said outer circular periphery working means.

14. The apparatus for automatically chamfering a wafer according to claim 1, said wafer transferring means including a transferring arm adapted to rotate about one end thereof, a suction portion provided at the other end of said transferring arm, and a driving means for driving said transferring arm so as to rotate the same.

15. The apparatus for automatically chamfering a wafer according to claim 14, said wafer transferring means including a cleaning unit for cleaning said suction portion of said transferring arm.

16. The apparatus for automatically chamfering a wafer according to claim 1, further comprising an inversion means for inverting said wafer having had its one side surface chamfered by said chamfer-machining means and thereafter positioning said wafer thus inverted, and a transferring means for transferring said inverted wafer between said inversion means and said chamfer-machining means.

17. The apparatus for automatically chamfering a wafer according to claim 16, said inversion means including an inversion stage and an inversion unit, said inversion stage including a plurality of positioning arms of equal length which rotate about points on the same circle, respectively, inwardly pressing rollers provided at fore ends of said positioning arms, respectively, and a driving means for causing said positioning arms to rotate through the same degree of angle and in the same direction, said inversion unit including an inversion arm adapted to rotate about one end thereof and to move upwardly and downwardly, a suction portion provided at the other end of said inversion arm, and a driving means for driving said inversion arm.

18. The apparatus for automatically chamfering a wafer according to claim 1, said wafer recovering means including a water chute in which water is accommodated, a wafer receiving cassette which is immersed in said water within said water chute, a height adjustable table having said wafer receiving cassette placed thereon and adapted to move said wafer receiving cassette upwardly and downwardly, and a guide plate disposed in such a manner that said guide plate is obliquely downwardly inclined toward said wafer receiving cassette and formed with water holes adapted to allow said water to be jetted over an upper surface of said guide plate.

19. An apparatus for automatically chamfering a wafer, said apparatus comprising:

wafer supply means for sequentially supplying a wafer one by one, wafer positioning and setting means for positioning said wafer thus supplied and setting it on working stages, chamfer-machining means for chamfering said wafer thus positioned and set, wafer recovering means for recovering said wafer thus chamfered, wafer transferring means for performing at least one transfer operation, said transfer operations including transferring said wafer from said wafer positioning and setting means to said chamfer-machining means and transferring said wafer from said chamfer-machining means to said wafer recovering means, and an inversion means for inverting said wafer having had its one side surface chamfered by said chamfer-machining means and thereafter positioning said wafer thus inverted, and a transferring means for transferring said inverted wafer between said inversion means and said chamfer-machining means.

20. An apparatus for automatically chamfering a wafer, said apparatus comprising:

wafer supply means for sequentially supplying a wafer one by one, wafer positioning and setting means for positioning said wafer thus supplied and setting it on working stages, chamfer-machining means for chamfering said wafer thus positioned and set, after recovering means for recovering said wafer thus chamfered, said wafer recovering means including a water chute in which water is accommodated, a wafer receiving cassette which is immersed in said water within said water chute, a height adjustable table having said wafer receiving cassette placed thereon and adapted to move said wafer receiving cassette upwardly and downwardly, and a guide plate disposed in such a manner that said guide plate is obliquely downwardly inclined toward said wafer receiving cassette and formed with water holes adapted to allow said water to be jetted over an upper surface of said guide plate, and wafer transferring means for performing at least one transfer operation, said transfer operations including transferring said wafer from said wafer positioning and setting means to said chamfer-machining means and transferring said wafer from said chamfer-machining means to said wafer recovering means.

* * * * *